US007531081B2

(12) United States Patent
Daniel et al.

(10) Patent No.: US 7,531,081 B2
(45) **Date of Patent: *May 12, 2009**

(54) BASE OIL COMPOSITION

(75) Inventors: Mervyn Frank Daniel, Katy, TX (US); Gilbert Robert Bernard Germaine, Petit Couronne (FR); David John Wedlock, Chester (GB)

(73) Assignee: Shell Oil Company, Houston, TX (US)

( * ) Notice: Subject to any disclaimer, the term of this patent is extended or adjusted under 35 U.S.C. 154(b) by 689 days.

This patent is subject to a terminal disclaimer.

(21) Appl. No.: 10/467,731

(22) PCT Filed: Feb. 13, 2002

(86) PCT No.: PCT/EP02/01634

§ 371 (c)(1),
(2), (4) Date: Jan. 9, 2004

(87) PCT Pub. No.: WO02/064710

PCT Pub. Date: Aug. 22, 2002

(65) Prior Publication Data

US 2004/0118744 A1 Jun. 24, 2004

(30) Foreign Application Priority Data

| | | |
|---|---|---|
| Feb. 13, 2001 | (EP) | 01301272 |
| Mar. 5, 2001 | (EP) | 01400562 |
| Aug. 16, 2001 | (EP) | 01402181 |

(51) Int. Cl.
*C10M 105/04* (2006.01)

(52) U.S. Cl. ..... 208/18; 208/19; 208/24; 208/950; 585/20; 585/21; 508/110

(58) Field of Classification Search ..... 585/20, 585/21; 208/18, 19
See application file for complete search history.

(56) References Cited

U.S. PATENT DOCUMENTS

| | | | | |
|---|---|---|---|---|
| 135,150 | A | 1/1873 | Pearce | |
| 2,603,589 | A | 7/1952 | Schaerer | 196/17 |
| 3,876,522 | A | 4/1975 | Campbell et al. | 208/58 |
| 3,965,018 | A | 6/1976 | Heilman et al. | 252/59 |
| 4,299,714 | A | 11/1981 | Sugiura et al. | 252/73 |
| 4,343,692 | A | 8/1982 | Winquist | 208/111 |
| 4,574,043 | A | 3/1986 | Chester et al. | |
| 4,582,616 | A | 4/1986 | Kita et al. | 252/17 |
| 4,859,311 | A | 8/1989 | Miller | |
| 4,919,788 | A | 4/1990 | Chen et al. | 208/59 |

(Continued)

FOREIGN PATENT DOCUMENTS

AU 698392 9/1995

(Continued)

OTHER PUBLICATIONS

International Search Report dated Jul. 29, 2002.

(Continued)

*Primary Examiner*—Ellen M. McAvoy

(57) ABSTRACT

A lubricating base oil composition having at least 95 wt % saturates, of which saturates fraction between 10 and 30 wt % are cyclo-paraffins and the remainder being n- and iso-paraffins, having a viscosity index of above 120 and a pour point of below −15° C.

20 Claims, 1 Drawing Sheet

U.S. PATENT DOCUMENTS

| | | | | |
|---|---|---|---|---|
| 4,922,047 | A * | 5/1990 | Chen et al. | 585/12 |
| 4,943,672 | A | 7/1990 | Hamner et al. | 585/737 |
| 4,983,273 | A | 1/1991 | Kennedy et al. | 208/89 |
| 5,053,373 | A | 10/1991 | Zones | |
| 5,059,299 | A | 10/1991 | Cody et al. | 208/27 |
| 5,064,546 | A * | 11/1991 | Dasai | 508/436 |
| 5,135,638 | A | 8/1992 | Miller | 208/27 |
| 5,157,191 | A | 10/1992 | Bowes et al. | |
| 5,252,527 | A | 10/1993 | Zones | |
| 5,362,378 | A | 11/1994 | Borghard et al. | |
| 5,370,818 | A | 12/1994 | Schleifstein | 252/186.25 |
| 5,372,703 | A * | 12/1994 | Kamiya et al. | 208/58 |
| 5,447,621 | A | 9/1995 | Hunter | 208/58 |
| 5,456,820 | A | 10/1995 | Forbus, Jr. et al. | 208/111 |
| 5,693,598 | A | 12/1997 | Abraham et al. | 508/444 |
| 5,723,716 | A | 3/1998 | Brandes et al. | 585/734 |
| 5,770,542 | A | 6/1998 | Brandes et al. | 502/527 |
| 5,804,058 | A | 9/1998 | Grandvallet et al. | 208/171 |
| 5,856,365 | A | 1/1999 | Zennaro et al. | 518/715 |
| 5,935,417 | A | 8/1999 | Cody et al. | 208/87 |
| 6,059,955 | A | 5/2000 | Cody et al. | 208/18 |
| 6,060,437 | A | 5/2000 | Robson et al. | 508/371 |
| 6,090,989 | A | 7/2000 | Trewella et al. | 585/13 |
| 6,103,099 | A | 8/2000 | Wittenbrink et al. | 208/27 |
| 6,165,949 | A | 12/2000 | Berlowitz et al. | |
| 6,179,994 | B1 | 1/2001 | Clark et al. | 208/27 |
| 6,245,719 | B1 * | 6/2001 | Kobori | 508/110 |
| 6,491,809 | B1 * | 12/2002 | Briot et al. | 208/18 |
| 6,627,779 | B2 | 9/2003 | O'Rear | 585/302 |
| 6,642,189 | B2 | 11/2003 | Kurihara et al. | 508/364 |
| 6,828,283 | B2 * | 12/2004 | Chapaton et al. | 508/110 |
| 7,015,178 | B2 * | 3/2006 | Koga et al. | 508/463 |
| 7,045,488 | B2 * | 5/2006 | Bartley et al. | 508/110 |
| 7,056,869 | B2 * | 6/2006 | Guyomar et al. | 508/110 |
| 7,083,713 | B2 * | 8/2006 | Abernathy et al. | 208/18 |
| 7,332,072 | B2 * | 2/2008 | Germaine et al. | 208/108 |
| 2003/0119682 | A1 | 6/2003 | Saini et al. | 508/167 |
| 2004/0099571 | A1 | 5/2004 | Germaine et al. | 208/108 |
| 2004/0118744 | A1 | 6/2004 | Daniel et al. | 208/18 |
| 2004/0192979 | A1 | 9/2004 | Matthai et al. | 585/16 |

FOREIGN PATENT DOCUMENTS

| | | |
|---|---|---|
| EP | 113579 | 12/1988 |
| EP | 426223 | 10/1990 |
| EP | 0 435 670 | 7/1991 |
| EP | 323092 | 4/1992 |
| EP | 0237655 | 6/1992 |
| EP | 0 532 118 | 3/1993 |
| EP | 0471524 | 11/1994 |
| EP | 0 666 894 | 8/1995 |
| EP | 0 668 342 | 8/1995 |
| EP | 0 776 959 | 6/1997 |
| EP | 0 832 171 | 1/2000 |
| EP | 1102827 | 9/2002 |
| EP | 1389635 | 2/2004 |
| EP | 1400562 | 3/2004 |
| EP | 1402181 | 3/2004 |
| EP | 1370633 | 8/2005 |
| EP | 1365005 | 10/2005 |
| EP | 1368446 | 10/2005 |
| EP | 1366134 | 11/2005 |
| FR | 0002364 | 2/1963 |
| GB | 713910 | 8/1954 |
| JP | 401133988 | 5/1989 |
| WO | WO9410263 | 5/1994 |
| WO | WO9523765 | 9/1995 |
| WO | WO9603359 | 2/1996 |
| WO | WO97/18278 | 5/1997 |
| WO | WO9721788 | 6/1997 |
| WO | WO9802503 | 1/1998 |
| WO | 99/20720 | 4/1999 |
| WO | 99/14188 | 7/1999 |
| WO | 00/14179 | 3/2000 |
| WO | 00/14183 | 3/2000 |
| WO | 00/14187 | 3/2000 |
| WO | 00/14188 | 3/2000 |
| WO | 00/15736 | 3/2000 |
| WO | WO0014184 | 3/2000 |
| WO | WO0015732 | 3/2000 |
| WO | 00/29511 | 5/2000 |
| WO | 00/71646 | 11/2000 |
| WO | WO0107538 | 2/2001 |
| WO | WO0118156 | 3/2001 |
| WO | 01/57166 | 8/2001 |
| WO | WO0157166 | 8/2001 |
| WO | WO0164610 | 9/2001 |
| WO | WO0174969 | 10/2001 |
| WO | WO0207878 | 1/2002 |
| WO | WO02070630 | 7/2002 |
| WO | WO02064710 | 8/2002 |
| WO | WO02064711 | 8/2002 |
| WO | WO02070627 | 9/2002 |
| WO | WO02070629 | 9/2002 |
| WO | WO02096842 | 12/2002 |
| WO | WO03004875 | 1/2003 |

OTHER PUBLICATIONS

Kirk-Othmer Encyclopedia of Chemical Technology. 3rd edition. vol. 14, pp. 477-526.

Fischer-Tropsch Waxes, Ed. J.H. Le Roux and S. Oranje, SA, Mar. 13, 1984, p. 30-32.

Synthetic Lubricants and High-Performance Functional Fluids, Marcel Dekker, Onc. 1993, pp. 1-6 and 9.

R. M. Mortimer & S. T. Orszulik, Chemistry and Technology of Lubricants, Second Edition, pp. 4-5, 1997.

Nicholas P. Cheremisinoff, Ph.D., Polymer Characterization Laboratory Techniques and Analysis, p. 187, 1996.

L. Monanari et al., "NMR Molecular Characterization of Lubricating Base Oils: Correlation With Their Performance," Applied Magnetic Resonance, 14, pp. 345-356, 1998.

A. S. Sarpal et al., "Characterization by $^{13}C$ n.m.r. Spectroscopy of Base Oils Produced by Different Processes," Fuel, vol. 76, No. 10, pp. 931-937, 1997.

Shell Safety Data Sheet, dated Aug. 1996.

Affidavit of John Rosenbaum, Jul. 2006.

Affidavit of Susan Abernathy, Jul. 25, 2006.

ASTM 4684, "Standard Test Method for Determination of Yield Stress and Apparent Viscosity of Engine Oils at Low Temperature", Apr. 2000.

SAE J300, Surface Vehicle Standard, Engine Oil Viscosity Classification.

Marcel Dekker, "Lubricant Additives, Chemistry and Applications," 270 Madison Avenue, NY 10016, ISBN-08247-0857-1, pp. 315-319, 2003.

ASTM D5293-99a, "Standard Test Method for Apparent Viscosity of Engine Oils Between −5 and −35° C. Using the Cold-Cranking Simulator", Nov. 2000.

EP Application 01301272.9 (a priority document of the patent in suit), Feb. 2001.

ASTM D3238-95, "Standard Test Method for Calculation of Carbon Distribution and Structural Group Analysis of Petroleum Oils by the n-d-M Method", Nov. 2001.

Brochure of Shell MDS (Malaysia), dated May 1995.

A transcript of a Lecture by Tijm et al., entitled "The Markets for Shell Middle Distillate Synthesis Products," Alternative Energy '95, Vancouver Canada, May 2-4, 1995.

Letter from Opponent 02 in Opposition proceedings against EP-B-1102827.

Page 11 of a letter dated Nov. 1, 2004 from Opponent 02 in Opposition proceedings against EP-B-1102827.

IP368/01, "Determination of Hydrocarbon Types in Lubricating Oil Basestocks—Preparative High Performance Liquid Chromatography Method" and Appendix E.
D. C. Kramer et al., Influence of Group II & III Base Oil Composition on VI and Oxidation Stability, Prepared for Presentation at the 1999 AIChE Spring Meeting in Houston, Mar. 14-18, 1999.
G. Klesper & F. W. Röllgen, "Field-induced Ion Chemistry Leading to the Formation of $(M-2nH)^+$ and $(2M-2mH)^+$ Ions in Field Desorption Mass Spectrometry of Saturated Hydrocarbons," J. of Mass Spectrometry, vol. 31, pp. 383-388, 1996.
Z. Liang & C. S. Hsu, "Molecular Speciation of Saturates by On-Line Liquid Chromatography-Field Ionization Mass Spectrometry," Energy & Fuels, 12, pp. 637-643, 1998.
Avilino Sequeira, Lubricant Base Oil & Wax Process, Chapter 7, Marcel Dekker. NY94.
M. M. G. Senden, "The Shell Middle Distillate Synthesis Process: Commercial Plant Experience and Outlook Into the Future," Petrole et Techniques, Association Francaise Des Technic, Paris, Fr., No. 415, Jul. 1998, XP00)771962, pp. 94-97.
"Shell Middle Distillate Synthesis," Internet article, XP-002214343.
Sie, S. T., "Conversion of Natural Gas to Transportation Fuels Via The Shell Middle Distillate Synthesis Process (SMDS)," *Catalysis Today,* 8 (1991) pp. 371-394.
Shell MDS (Malaysia) "Manufacturing Clean Products From Natural Gas".
1995 ASTM D86 "Standard Test Method for Distillation of Petroleum Products at Atmospheric Pressure", Aug. 2006.
ASTM D1160 "Standard Method for Distillation of Petroleum Products at Reduced Pressure", Jul. 2006.
Extract from the website http://www.schu.ac.uk, providing a description of the gas chromatography technique, Aug. 2006.
Pavia, D. L. et al. "Introduction to Organic Laboratory Techniques" 1976 pp. 614-625.
Letter from the Patentee to the EPO dated Jun. 14, 2004 in European Patent Application No. 02716826.9.
Extract from web-site http://www.deh.gov.au providing a summary of the development of the European Union Fuel standard through the years 1993 and 2000 (so-called "Euro-2" and "Euro-3" respectively) and beyond, for petrol (gasoline) and diesel fuel, Aug. 2006.
Lewis, R. J., Hawley's Condensed Chemical Dictionary, 14th Ed., John Wiley & Sons, New York, 2001 (p. 228).
Ballard, D. H., "Generalizing the Hough Transform to Detect Arbitrary Shapes," Pattern Recognition, vol. 13, No. 2, pp. 111-122, Sep. 1980.
Opponent Shell submission in opposition proceedings against EP-B-1102827, letter dated Nov. 2, 2004, pp. 2 and 16-22.
1996 exchange of correspondence between Shell Malaysia and Yukong, Jun. 1996.
1996 sales invoice of waxy raffinate to Bentley Chemplax (Australia), Aug. 1996.
Bill from Showa Shell to General Sekiyu dated Jun. 12, 1997.
Affidavit of Mr. Masami Sakaguchi dated Jun. 17, 2004.
Internal Showa Shell note dated Dec. 17, 1996 re shipment of Process Oil 123X.
Sample Request Form for waxy raffinate Jul. 1996.
1993 Showa Shell brochure on XHVI.
Shell records relating to retained sample of commercial XHVI 5.2 base oil.
1996 exchange of correspondence between Chevron and Shell Malaysia, Jun. 21, 1996.
R. M. Mortier & S. T. Orszulik, "Chemistry and Technology of Lubricants," 2nd Ed., pp. 4-5, 1997.
Affidavit of Dennis O'Rear, 2007.
Lucie Coniglio and Armelle Nouviaire "A Method for Estimating the Normal Boiling Point of Heavy Hydrocarbons Suitable for a Group-Contribution-Based Equation of State," published in 2001 by the American Chemical Society, Ind. Eng. Chem. Res. 2001, 40, pp. 1781-1790.
Chevron Opposition Letter of May 16, 2006.
Letter from the EPO—Apr. 8, 2008—Chevron has withdrawn the Opposition.
Dissertation of Glenda Vanessa Webber, "Wax Characterisation by Instrumental Analysis," Sep. 2000.
Sasolwax H1 Certificate of Analyses, Feb. 1993.

* cited by examiner

BASE OIL COMPOSITION

FIELD OF THE INVETION

The invention is directed to a lubricating base oil composition having a viscosity index of above 120 and a pour point of below −15° C. and wherein the composition comprises at least 95 wt % saturates, of which saturates fraction between 10 and 40 wt % are cyclo-paraffins and the remainder being n- and iso-paraffins and wherein the weight ratio of 1-ring cyclo-paraffins relative to cyclo-paraffins having two or more rings is greater than 3.

BACKGROUND OF THE INVENTION

EP-A-435670 illustrates base oils containing between 65.1 and 69.5 wt % of iso-paraffins and monocyclic naphthene compounds in its saturates fraction and having a pour point of −15° C. This publications also teaches that a high content of these compounds is desirable because they contribute greatly to increased viscosity index and resistance to oxidation.

Known from WO-A-0014179, WO-A-0014183, WO-A-0014187 and WO-A-0014188 are lubricant base stock comprising at least 95 wt % of non-cyclic isoparaffins. WO-A-0118156 describes a base oil derived from a Fischer-Tropsch product having a naphthenics content of less than 10%. Also the base oils as disclosed in applicant's patent applications EP-A-776959 or EP-A-668342 have been found to comprise less than 10 wt % of cyclo-paraffins. Applicants repeated Example 2 and 3 of EP-A-776959 and base oils were obtained, from a waxy Fischer-Tropsch synthesis product, wherein the base oils consisted of respectively about 96 wt % and 93 wt % of iso- and normal paraffins. Applicants further prepared a base oil having a pour point of −21° C. by catalytic dewaxing a Shell MDS waxy Raffinate (as obtainable from Shell MDS Malaysia Sdn Bhd) using a catalyst comprising synthetic ferrierite and platinum according to the teaching of EP-A-668342 and found that the content of iso- and normal paraffins was about 94 wt %. Thus these prior art base oils derived from a Fischer-Tropsch synthesis product had at least a cyclo-paraffin content of below 10 wt %. Furthermore the base oils as disclosed by the examples of application WO-A-9920720 will not comprise a high cyclo-paraffin content. This because feedstock and preparation used in said examples is very similar to the feedstock and preparation to prepare the above prior art samples based on EP-A-776959 and EP-A-668342.

SUMMARY OF THE INVENTION

Applicants have now found a lubricating base oil composition having an improved solvency when compared to the disclosed base oils. This is found to be advantageous in for example industrial formulations such as turbine oils and hydraulic oils comprising for the greater part the base oil according to the invention. Furthermore the base oil compositions will cause seals in for example motor engines to swell more than the prior art base oils. This is advantageous because due to said swelling less lubricant loss will be observed in certain applications. Applicants have found that such a base oil is an excellent API Group III base oil having improved solvency properties.

DETAILED DESCRIPTION OF THE INVENTION

Figure 1:
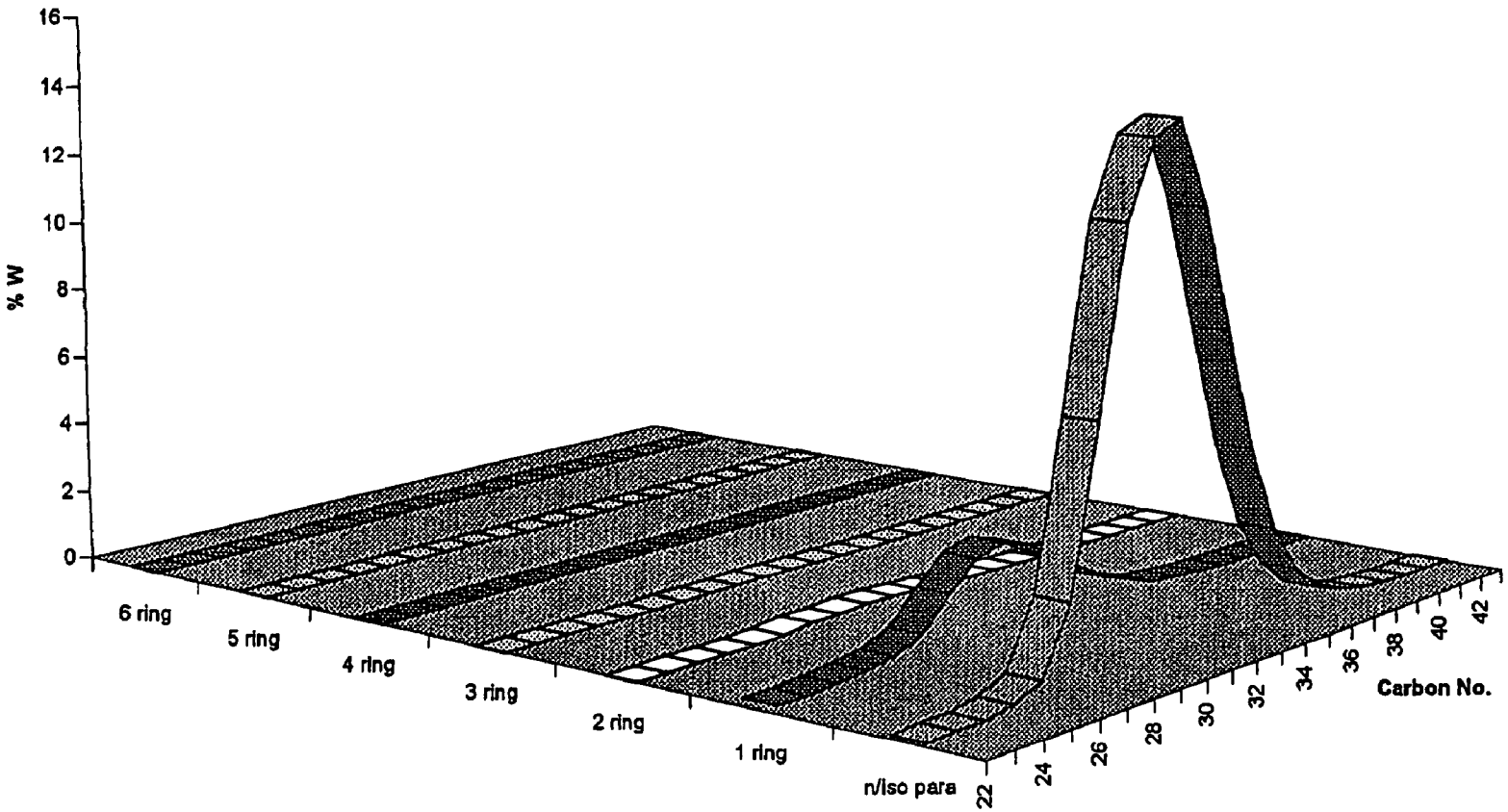
In FIG. 1, the content of normal and iso-paraffins, 1-ring cycloparaffins, 2-ring cycloparaffins, etc., in the saturates phase as a function of their respective carbon numbers is shown of a base oil according to the invention.

The lubricating base oil composition comprises preferably at least 98 wt % saturates, more preferably at least 99.5 wt % saturates and most preferably at least 99.9 wt %. This saturates fraction in the base oil comprises between 10 and 40 wt % of cyclo-paraffins. Preferably the content of cyclo-paraffins is less than 30 wt % and more preferably less than 20 wt %. Preferably the content of cyclo-paraffins is at least 12 wt % and more preferably at least 15 wt %. The unique and novel base oils are further characterized in that the weight ratio of 1-ring cyclo-paraffins relative to cyclo-paraffins having two or more rings is greater than 3 preferably greater than 5. It was found that this ratio is suitably smaller than 15.

The cyclo-paraffin content as described above is measured by the following method. Any other method resulting in the same results may also be used. The base oil sample is first separated into a polar (aromatic) phase and a non-polar (saturates) phase by making use of a high performance liquid chromatography (HPLC) method IP368/01, wherein as mobile phase pentane is used instead of hexane as the method states. The saturates and aromatic fractions are then analyzed using a Finnigan MAT90 mass spectrometer equipped with a Field desorption/Field Ionisation (FD/FI) interface, wherein FI (a "soft" ionisation technique) is used for the semi-quantitative determination of hydrocarbon types in terms of carbon number and hydrogen deficiency. The type classification of compounds in mass spectrometry is determined by the characteristic ions formed and is normally classified by "z number". This is given by the general formula for all hydrocarbon species: $C_nH_{2n+z}$. Because the saturates phase is analysed separately from the aromatic phase it is possible to determine the content of the different (cyclo)-paraffins having the same stoichiometry. The results of the mass spectrometer are processed using commercial software (poly 32; available from Sierra Analytics LLC, 3453 Dragoo Park Drive, Modesto, Calif. GA95350 USA) to determine the relative proportions of each hydrocarbon type and the average molecular weight and polydispersity of the saturates and aromatics fractions.

The base oil composition preferably has a content of aromatic hydrocarbon compounds of less than 1 wt %, more preferably less than 0.5 wt % and most preferably less than 0.1 wt %, a sulphur content of less than 20 ppm and a nitrogen content of less than 20 ppm. The pour point of the base oil is preferably less than −30° C. and more preferably lower than −40° C. The viscosity index is higher than 120. It has been found that the novel base oils typically have a viscosity index of below 140. The kinematic viscosity at 100° C. of the base oil is preferably between 3.5 and 6 cSt and the Noack volatility is between 6 and 14 wt %.

Applicants found that the base oil according to the invention is suitably prepared according to the following process wherein the following steps are performed:

(a) contacting a mixture of carbon monoxide and hydrogen with a hydrocarbon synthesis catalyst at elevated temperature and pressure to prepare a substantially paraffinic Fischer-Tropsch product, which product has a weight ratio of compounds having at least 60 or more carbon atoms and compounds having at least 30 carbon atoms in the Fischer-Tropsch product of at least 0.2 and wherein at least 30 wt % of compounds in the Fischer-Tropsch product have at least 30 carbon atoms (b) hydrocracking/hydroisomerisating the Fischer-Tropsch product, (c) separating the product of step (b) into one or more gas oil fractions, a base oil precursor fraction and a higher boiling fraction, (d) performing a pour point reducing step to the base oil precursor fraction obtained in step (c), and (e) recovering the lubricating base oil from the effluent of step (d).

Step (a) is preferably performed by making use of a specific catalyst in order to obtain the relatively heavy Fischer-Tropsch product. The Fischer-Tropsch catalyst is suitably a cobalt-containing catalyst as obtainable by (aa) mixing (1) titania or a titania precursor, (2) a liquid, and (3) a cobalt compound, which is at least partially insoluble in the amount of liquid used, to form a mixture; (bb) shaping and drying of the mixture thus obtained; and (cc) calcination of the composition thus obtained.

Preferably at least 50 weight percent of the cobalt compound is insoluble in the amount of liquid used, more preferably at least 70 weight percent, and even more preferably at least 80 weight percent, and most preferably at least 90 weight percent. Preferably the cobalt compound is metallic cobalt powder, cobalt hydroxide or an cobalt oxide, more preferably $Co(OH)_2$ or $CO_3O_4$. Preferably the cobalt compound is used in an amount of up to 60 weight percent of the amount of refractory oxide, more preferably between 10 and 40 wt percent. Preferably the catalyst comprises at least one promoter metal, preferably manganese, vanadium, rhenium, ruthenium, zirconium, titanium or chromium, most preferably manganese. The promoter metal(s) is preferably used in such an amount that the atomic ratio of cobalt and promoter metal is at least 4, more preferably at least 5. Suitably at least one promoter metal compound is present in step (aa). Suitably the cobalt compound is obtained by precipitation, optionally followed by calcination. Preferably the cobalt compound and at least one of the compounds of promoter metal are obtained by co-precipitation, more preferably by co-precipitation at constant pH. Preferably the cobalt compound is precipitated in the presence of at least a part of the titania or the titania precursor, preferably in the presence of all titania or titania precursor. Preferably the mixing in step (aa) is performed by kneading or mulling. The thus obtained mixture is subsequently shaped by pelletising, extrusion, granulating or crushing, preferably by extrusion. Preferably the mixture obtained has a solids content in the range of from 30 to 90% by weight, preferably of from 50 to 80% by weight. Preferably the mixture formed in step (aa) is a slurry and the slurry thus-obtained is shaped and dried by spray-drying. Preferably the slurry obtained has a solids content in the range of from 1 to 30% by weight, more preferably of from 5 to 20% by weight. Preferably the calcination is carried out at a temperature between 400 and 750° C., more preferably between 500 and 650° C. Further details are described in WO-A-9934917 here incorporated by reference.

The process is typically carried out at a temperature in the range from 125 to 350° C., preferably 175 to 275° C. The pressure is typically in the range from 5 to 150 bar abs., preferably from 5 to 80 bar abs., in particular from 5 to 50 bar abs. Hydrogen ($H_2$) and carbon monoxide (synthesis gas) is typically fed to the process at a molar ratio in the range from 0.5 to 2.5. The gas hourly space velocity (GHSV) of the synthesis gas in the process of the present invention may vary within wide ranges and is typically in the range from 400 to 10000 Nl/l/h, for example from 400 to 4000 Nl/l/h. The term GHSV is well known in the art, and relates to the volume of synthesis gas in Nl, i.e. litres at STP conditions (0° C. and 1 bar abs), which is contacted in one hour with one litre of catalyst particles, i.e. excluding interparticular void spaces. In the case of a fixed catalyst bed, the GHSV may also be expressed as per litre of catalyst bed, i.e. including interparticular void space. Step (a) can be performed in a slurry reactor or preferably in a fixed bed. Further details are described in WO-A-9934917 hereby incorporated by reference.

The Fischer-Tropsch product obtained in step (a), optionally after separating some of the lower boiling compounds, for example the compounds having 4 carbon atoms or less and any compounds having a boiling point in that range, is used in step (b). This product has at least 30 wt %, preferably at least 50 wt % and more preferably at least 55 wt %, of compounds having at least 30 carbon atoms. Furthermore the weight ratio of compounds having at least 60 or more carbon atoms and compounds having at least 30 carbon atoms of the Fischer-Tropsch product is at least 0.2, preferably at least 0.4 and more preferably at least 0.55. Preferably the Fischer-Tropsch product comprises a $C_{20}^+$ fraction having an ASF-alpha value (Anderson-Schulz-Flory chain growth factor) of at least 0.925, preferably at least 0.935, more preferably at least 0.945, even more preferably at least 0.955. The initial boiling point of the Fischer-Tropsch product may range up to 400° C., but is preferably below 200° C.

The Fischer-Tropsch product as described in detail above suitably has a content of non-branched compounds of above 80 wt %. In addition to the Fischer-Tropsch product obtained in step (a) also other fractions may be additionally processed in step (b). A possible other fraction may suitably be the higher boiling fraction obtained in step (c) or part of said fraction.

The Fischer-Tropsch product will contain no or very little sulphur and nitrogen containing compounds. This is typical for a product derived from a Fischer-Tropsch reaction, which uses synthesis gas containing almost no impurities. Sulphur and nitrogen levels will generally be below the detection limit, which is currently 1 ppm for nitrogen and 5 ppm for sulphur.

The Fischer-Tropsch product can optionally be subjected to a mild hydrotreatment step before performing step (b) in order to remove any oxygenates and saturate any olefinic compounds present in the reaction product of the Fischer-Tropsch reaction. Such a hydrotreatment is described in EP-B-668342 hereby incorporated by referece.

The hydrocracking/hydroisomerisation reaction of step (b) is preferably performed in the presence of hydrogen and a catalyst, which catalyst can be chosen from those known to one skilled in the art as being suitable for this reaction. Catalysts for use in step (b) typically comprise an acidic functionality and a hydrogenation/dehydrogenation functionality. Preferred acidic functionalities are refractory metal oxide carriers. Suitable carrier materials include silica, alumina, silica-alumina, zirconia, titania and mixtures thereof. Preferred carrier materials for inclusion in the catalyst for use in the process of this invention are silica, alumina and silica-alumina. A particularly preferred catalyst comprises platinum or platinum/palladium supported on a silica-alumina carrier. If desired, applying a halogen moiety, in particular fluorine, or a phosphorous moiety to the carrier, may enhance the acidity of the catalyst carrier. Examples of suitable hydrocracking/hydroisomerisation processes and suitable catalysts are described in WO-A-0014179, EP-A-532118, EP-B-666894 and the earlier referred to EP-A-776959 all are hereby incorporated by reference. The hydrocracking catalyst may also contain a molecular sieve as for example described in U.S. Pat. No. 5,362,378 hereby incorporated by reference.

Preferred hydrogenation/dehydrogenation functionalities are Group VIII noble metals, for example palladium and more preferably platinum or platinum/palladium alloys. The catalyst may comprise the hydrogenation/dehydrogenation active component in an amount of from 0.005 to 5 parts by weight, preferably from 0.02 to 2 parts by weight, per 100 parts by weight of carrier material. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder can be non-acidic. Examples are clays and other binders known to one skilled in the art.

In step (b) the feed is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bar and preferably between 20 and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in step (b) as defined as the weight percentage of the feed boiling above 370° C. which reacts per pass to a fraction boiling below 370° C., is at least 20 wt %, preferably at least 25 wt %, but preferably not more than 80 wt %, more preferably not more than 65 wt %. The feed as used above in the definition is the total hydrocarbon feed fed to step (b), thus also any optional recycles, such as the higher boiling fraction as obtained in step (c).

In step (c) the product of step (b) is separated into one or more gas oil fractions, a base oil precursor fraction having preferably a T10 wt % boiling point of between 200 and 450° C. and a T90 wt % boiling point of between 300 and 650 preferably 550° C. and a higher boiling fraction. By performing step (d) on the preferred narrow boiling base oil precursor fraction obtained in step (c) a haze free base oil grade can be obtained having also excellent other quality properties. The separation is preferably performed by means of a first distillation at about atmospheric conditions, preferably at a pressure of between 1.2-2 bara, wherein the gas oil product and lower boiling fractions, such as naphtha and kerosine fractions, are separated from the higher boiling fraction of the product of step (b). The higher boiling fraction, of which suitably at least 95 wt % boils above 350 preferably above 370° C., is subsequently further separated in a vacuum distillation step wherein a vacuum gas oil fraction, the base oil precursor fraction and the higher boiling fraction are obtained. The vacuum distillation is suitably performed at a pressure of between 0.001 and 0.05 bara.

In step (d) the base oil precursor fraction obtained in step (c) is subjected to a pour point reducing treatment. With a pour point reducing treatment is understood every process wherein the pour point of the base oil is reduced by more than 10° C., preferably more than 20° C., more preferably more than 25° C.

Preferably step (d) is performed by means of a catalytic dewaxing process. With such a process it has been found that base oils having a pour point of below −20° C. and even below −40° C. can be prepared when starting from a base oil precursor fraction as obtained in step (c).

The catalytic dewaxing process can be performed by any process wherein in the presence of a catalyst and hydrogen the pour point of the base oil precursor fraction is reduced as specified above. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of the base oil precursor fraction under catalytic dewaxing conditions. Preferably the intermediate pore size zeolites have a pore diameter of between 0.35 and 0.8 nm. Suitable intermediate pore size zeolites are mordenite, ZSM-5, ZSM-12, ZSM-22, ZSM-23, SSZ-32, ZSM-35 and ZSM-48. Another preferred group of molecular sieves are the silica-aluminaphosphate (SAPO) materials of which SAPO-11 is most preferred as for example described in U.S. Pat. No. 4,859,311 hereby incorporated by reference. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Ni/ZSM-5, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat. Nos. 5,053,373, 5,252,527 and 4,574,043 all are hereby incorporated by reference.

The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material, which is essentially free of alumina, is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is by contacting an extrudate of the binder and the zeolite with an aqueous solution of a fluorosilicate salt as described in for example U.S. Pat. No. 5,157,191 hereby incorporated by reference. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22, as for example described in WO-A-0029511 and EP-B-832171 both are hereby incorporated by reference.

Catalytic dewaxing conditions are known in the art and typically involve operating temperatures in the range of from 200 to 500° C., suitably from 250 to 400° C., hydrogen pressures in the range of from 10 to 200 bar, preferably from 40 to 70 bar, weight hourly space velocities (WHSV) in the range of from 0.1 to 10 kg of oil per litre of catalyst per hour (kg/l/hr), suitably from 0.2 to 5 kg/l/hr, more suitably from 0.5 to 3 kg/l/hr and hydrogen to oil ratios in the range of from 100 to 2,000 litres of hydrogen per litre of oil. By varying the temperature between 315 and 375° C. at between 40-70 bars, in the catalytic dewaxing step it is possible to prepare base oils having different pour point specifications varying from suitably −10 to below −60° C.

After performing a catalytic dewaxing step (d) lower boiling compounds formed during catalytic dewaxing are removed, preferably by means of distillation, optionally in combination with an initial flashing step. The remaining fraction can be further separated into one or more base oil products, wherein at least one base oil product is the base oil composition according to the present invention.

The base oils according to the invention can be suitably used as part of a motor engine lubricant composition comprising also at least one lubricant additive. Because of its improved solvency as compared to poly-alpha olefins or to the base oils having the lower cyclo-paraffin content as disclosed in the above cited publications it has been found possible to advantageously formulate said lubricants without having to add substantial volumes of (di-)esters which are typically used to increase the solvency of said base oils. Preferably the content of such additional base oil is less than 10 wt % in said formulation.

More preferably the lubricant composition comprises the base oil and one or more additives wherein the lubricant composition has a kinematic viscosity at 100° C. of more than 5.6 cSt, a cold cranking simulated dynamic viscosity at −35° C. according to ASTM D 5293 of less than 6200 centipoise (cP) and a mini rotary viscosity test value of less than 60000 cP according to ASTM D 4684.

Such lubricant compositions are also referred to as SAE 0W-x compositions. SAE stands for Society of Automotive Engineers in the USA. The "0" number in such a designation is associated with a maximum viscosity requirement at −35° C. for that composition as measured typically by a cold cranking simulator (VdCCS) under high shear. The second number "x" is associated with a kinematic viscosity requirement at 100° C.

The minimum high temperature viscosity requirement at 100° C. is intended to prevent the oil from thinning out too much during engine operation, which can lead to excessive wear and increased oil consumption. The maximum low temperature viscosity requirement, VdCCS, is intended to facilitate engine starting or cranking in cold weather. To ensure pumpability the cold oil should readily flow or slump into the well for the oil pump, otherwise the engine can be damaged due to insufficient lubrication. The mini rotary viscosity (MRV) requirement is intended to ensure a minimum pumpability performance. The base oil as obtainable by the above processes has a pour point of less than −39° C. and a kinematic viscosity at 100° C. which is suitably between 4 and 8 cSt. The actual kinematic viscosity at 100° C. will depend on the specific 0W-x grade one wishes to prepare. For the 0W-20 and 0W-30 lubricant grades a base oil having a kinematic viscosity at 100° C. of between 3.8 and 5.5 cSt is suitably used. For an 0W-40 grade a base oil having a kinematic viscosity at 100° C. of between 5.5 and 8 cSt is suitably used.

Such a lubricant formulation is preferably used as an 0W-x passenger car motor oil or 0W-x heavy duty diesel engine oil, wherein x is 20, 30 or 40.

The 0W-x lubricant composition comprises one or more additives. Examples of additive types which may form part of the composition are dispersants, detergents, viscosity modifying polymers, extreme pressure/antiwear additives, antioxidants, pour point depressants, emulsifiers, demulsifiers, corrosion inhibitors, rust inhibitors, antistaining additives, friction modifiers. Specific examples of such additives are described in for example Kirk-Othmer Encyclopedia of Chemical Technology, third edition, volume 14, pages 477-526.

Suitably the anti-wear additive is a zinc dialkyl dithiophosphate. Suitably the dispersant is an ashless dispersant, for example polybutylene succinimide polyamines or Mannic base type dispersants. Suitably the detergent is an over-based metallic detergent, for example the phosphonate, sulfonate, phenolate or salicylate types as described in the above referred to General Textbook. Suitably the antioxidant is a hindered phenolic or aminic compound, for example alkylated or styrenated diphenylamines or ionol derived hindered phenols. Suitably the viscosity modifier is a viscosity modifying polymer, for example polyisobutylenes, olefin copolymers, polymethacrylates and polyalkylstyrenes and hydrogenated polyisoprene star polymer (Shellvis). Examples of suitable antifoaming agents are polydimethyl-siloxanes and polyethylene glycol ethers and esters.

Another class of lubricant applications are industrial oil formulations, preferably turbine oils and hydraulic oils. Preferred formulations comprise more than 90 wt % of the base oil according to the present invention and between 0.5 and 3 wt % and preferably less than 2.5 wt % of an additive. The additives may be additives suited for the above applications, which are well known to one skilled in the art.

The invention shall be illustrated by means of the following non-limiting examples.

Example 1

Example 1 illustrates the process to prepare a base oil having a higher cyclo-paraffin content.

A Fischer-Tropsch product was made having boiling curve as in Table 1 by repeating Example VII of WO-A-9934917 hereby incorporated by reference, using the catalyst as prepared in Example III of the same publication and subsequently removing the $C_4$ and lower boiling compounds from the effluent of the synthesis reaction. The feed contained about 60 wt % $C_{30}$+ product. The ratio $C_{60}$+/$C_{30}$+ was about 0.55.

TABLE 1

| Recovered (wt %) | Temperature (° C.) |
|---|---|
| Initial boiling point | 82 |
| 10 | 249 |
| 30 | 424 |
| 50 | 553 |
| 70 | 671 |
| 90 | >750 |

The Fisher-Tropsch product as thus obtained was continuously fed to a hydrocracking step (step (a)). In the hydrocracking step the Fischer-Tropsch product and a recycle stream consisting of the 370° C.$^+$ fraction of the effluent of step (a) was contacted with a hydrocracking catalyst of Example 1 of EP-A-532118 hereby incorporated by reference, at a reactor temperature of 330° C. The Fischer-Tropsch product WHSV was contacted at 0.8 kg/l.h and the recycle stream was contacted at 0.2 kg/l.h at a total pressure of 35 bar and a hydrogen partial pressure of 33 bar. The recycle gas rate was 2000 Nl/kg of total feed. The conversion of compounds boiling above 370° C. in the total feed which were converted to products boiling below 370° C. was 55 wt %. The product of the hydrocracking step was distilled into one or more fuels fractions boiling in the naptha, kerosene and gas oil range and a bottom product boiling above 370° C.

The 370° C.$^+$ fraction thus obtained was in turn distilled in a vacuum distillation column, wherein the feed rate to the column was 750 g/h, the pressure at the top was kept at 0.4 mm Hg (0.5 mbar) and the temperature at the top was kept at 240° C., which is equal to an atmospheric cut off temperature of 515° C. The top product had thus a boiling range of between 370 and 515° C. Further properties were a pour point of +18° C. and a kinematic viscosity at 100° C. of 3.8 cSt. This top product was further used as the base oil precursor fraction in step (c).

In the dewaxing step (c) the base oil precursor fraction was contacted with a dealuminated silica bound ZSM-5 catalyst comprising 0.7% by weight Pt and 30 wt % ZSM-5 as described in Example 9 of WO-A-0029511 hereby incorporated by reference. The dewaxing conditions were: total pressure 40 bar, a hydrogen partial pressure at the reactor outlet of 36 bar, WHSV=1 kg/l.h, a temperature of 340° C. and a recycle gas rate of 500 Nl/kg feed.

The dewaxed oil was distilled, wherein a lighter and a heavier fraction was removed to obtain the final base oil having the improved solvency properties and the properties as listed in Table 2.

TABLE 2

| | |
|---|---|
| Density d20/4 | 814 |
| Mean boiling point (50 wt % recovered) | 430° C. |
| Kinematic viscosity at 40° C. | 18 cSt |
| Kinematic viscosity at 100° C. | 4.0 cSt |
| Viscosity index | 121 |
| Pour point | −50° C. |
| Noack volatility | 11 wt % |

Example 2

Example 1 was repeated except that the dewaxed oil was distilled differently to yield the base oil having the improved solvency properties and other properties as listed in Table 3.

TABLE 3

| | |
|---|---|
| Density d20/4 | 818 |
| Mean boiling point (50 wt % recovered) | 448° C. |
| Kinematic viscosity at 40° C. | 23.4 cSt |
| Kinematic viscosity at 100° C. | 4.9 cSt |
| Viscosity index | 128 |
| Pour point | −55° C. |
| Noack volatility | 6.8 wt % |

Example 3

74.6 weight parts of a base oil, having the properties as listed in Table 4 and which was obtained by catalytic dewaxing of a hydroisomerised/hydrocracked Fischer-Tropsch product as illustrated by Examples 1 and 2, was blended with 14.6 weight parts of a standard detergent inhibitor additive package, 0.25 weight parts of a corrosion inhibitor and 10.56 weight parts of a viscosity modifier. The properties of the resulting composition are listed in Table 5. Table 5 also shows the 0W-30 specifications for motor gasoline lubricants. It is clear that the composition as obtained in this Example meets the requirements of an 0W30 motor gasoline specification.

Comparative Experiment A 54.65 weight parts of a poly-alpha olefin-4 (PAO-4) and 19.94 weight parts of a poly-alpha olefin-5 (PAO-5), having the properties as listed in Table 1 were blended with the same quantity and quality of additives as in Example 3. The properties of the resulting composition are listed in Table 5. This experiment and Example 3 shows that a base oil as obtained by the present invention can be successfully used to formulate 0W-30 motor gasoline lubricants using the same additives as used to formulate such a grade based on poly-alpha olefins.

TABLE 4

| | PAO-4 | PAO-5 | Base oil of Example 3 |
|---|---|---|---|
| kinematic viscosity at 100° C.(1) | 3.934 | 5.149 | 4.234 |
| kinematic viscosity at 40° C. (2) | 17.53 | 24.31 | 19.35 |
| viscosity index (3) | 121 | 148 | 125 |
| VDCCS @ −35° C. (P) (4) | 13.63 | 23.08 | 21.17 |
| VDCCS @ −30° C. (P) (5) | 10.3 | 16 | 14.1 |
| MRV cP @ −40° C. (6) | 2350 | 4070 | 3786 |
| Pour Point ° C. (7) | less than −66 | −45 | −45 |
| Noack (wt %) (8) | 13.4 | 6.6 | 10.6 |
| Content(**) 1-ring cyclo-paraffins (wt %) | n.a.(*) | n.a. | 13 wt % |
| content 2-ring cyclo-paraffins (wt %) | n.a. | n.a. | 1 wt % |
| Content of 3 and higher ring cyclo-paraffins | n.a. | n.a. | <0.1 wt % |

(*)Not analysed but presumed to be zero due to the manner in which poly-alpha olefins are prepared.
(**)Content as based on the whole base oil composition (1) Kinematic viscosity at 100° C. as determined by ASTM D 445, (2) Kinematic viscosity at 40° C. as determined by ASTM D 445, (3) Viscosity Index as determined by ASTM D 2270, (4) VDCCS@−35° C. (P) stands for dynamic viscosity at −35 degrees Centigrade and is measured according to ASTM D 5293, (5) VDCCS@−35° C. (P) stands for dynamic viscosity at −35 degrees Centigrade and is measured according to ASTM D 5293, (6) MRV cP @−40° C. stands for mini rotary viscometer test and is measured according to ASTM D 4684, (7) pour point according to ASTM D 97, (8) Noack volatility as determined by ASTM D 5800.

TABLE 5

| | 0W-30 specifications | Example 3 | Comparative experiment A |
|---|---|---|---|
| kinematic viscosity at 100° C. (cSt) | 9.3–12.5 | 9.69 | 9.77 |
| VDCCS P @ −35° C. | 62.0 max | 61.2 | 48.3 |
| MRV cP @ −40° C. | 60000 max | 17500 | 12900 |
| Yield stress | No | No | No |
| Pour Point (° C.) | — | −60 | −60 |
| Noack (wt %) | — | 11.7 | 11.2 |

Example 4-5

Base oils as prepared from the same feed as in Examples 1 and 2 under varying conditions were prepared. Properties are listed in Table 6. The cyclo-paraffins and normal and iso-paraffins of the base oil of Example 5 (see Table 6) were further analysed. In FIG. 1 the content of the normal and iso-paraffins, 1-ring cyclo-paraffins, 2-ring cyclo-paraffins, etc, in the saturates phase as a function of their respective carbon numbers are shown of this base oil.

TABLE 6

| Base oil type | Example 4 | Example 5 | Base oil as obtained in Example 2 of EP-A-776959 | Base oil as obtained by catalytic dewaxing a Shell MDS Waxy Raffinate over a Pt/synthetic ferrierite catalyst (*) | Base oil as obtained by catalytic dewaxing a Shell MDS Waxy Raffinate over a Pt/synthetic ferrierite catalyst (**) |
|---|---|---|---|---|---|
| Viscosity Index | 127 | 121 | 151 | 138 | 132 |
| Pour point (° C.) | −48 | −54 | −19 | −21 | −39 |
| Kinematic viscosity at 100° C. (cSt) | 4.77 | 4.14 | 4.80 | 4.91 | 4.96 |
| Dynamic viscosity as measured by CCS at −40° C. (cP) | 5500 | 3900 | 6800 | 5300 cP | 5700 cP |
| Saturates content (wt %) | 99.1 | 99.9 | 99.8 | 99.7 | 91.4 |
| Total cyclo-paraffin content | 13.7 | 18.5 | 4.1 | 6.1 | 8.2 |
| 1-ring cyclo-paraffins (wt %) | 11.1 | 16.8 | 3.7 | 4.9 | 6.4 |
| 2-ring cyclo-paraffins | 1.4 | 1.4 | 0.2 | 0.5 | 0.7 |
| 3 and higher number rings cyclo-paraffins | 1.2 | 0.3 | 0.2 | 0.7 | 1.1 |

(*)Reaction conditions: total pressure 40 bars, WHSV = 1 kg/l/h, gas recycle rate = 700 Nl/kg feed and temperature of 290° C.
(**) as in (*) but at 320° C. dewaxing temperature

We claim:

1. A lubricating base oil composition formed from a Fischer-Tropsch derived product and having a viscosity index of above 120 and a pour point of below −15° C. and wherein the composition comprises at least 99.5 wt % saturates, of which saturates fraction between 10 and 40 wt % are cyclo-paraffins, the remainder being n- and iso-paraffins, and wherein a weight ratio of 1-ring cyclo-paraffins relative to cyclo-paraffins having two or more rings is greater than 3.

2. The base oil of claim 1, wherein the content of cyclo-paraffins in the saturates fraction is between 10 wt % and 30 wt %.

3. The base oil of claims 1, wherein the content of cyclo-paraffins in the saturates fraction is at least 12 wt %.

4. The base oil composition of claims 1, wherein the pour point is less than −30° C.

5. The base oil composition of claim 1, wherein the kinematic viscosity at 100° C. is between 3.5 cSt and 6 cSt and the Noack volatility is between 6 wt % and 14 wt %.

6. A process to prepare a lubricating base oil composition having a viscosity index of above 120 and a pour point of below −15° C. and wherein the composition comprises at least 95 wt % saturates, of which saturates fraction between 10 and 40 wt % are cyclo-paraffins, the remainder being n- and iso-paraffins, and wherein the weight ratio of 1-ring cyclo-paraffins relative to cyclo-paraffins having two or more rings is greater than 3 said process comprising:

(a) contacting a mixture of carbon monoxide and hydrogen with a hydrocarbon synthesis catalyst at elevated temperature and pressure to prepare a substantially paraffinic Fischer-Tropsch product, which product has a weight ratio of compounds having at least 60 or more carbon atoms and compounds having at least 30 carbon atoms in the Fischer-Tropsch product of at least 0.2 and wherein at least 30 wt % of compounds in the Fischer-Tropsch product have at least 30 carbon atoms;

(b) hydrocracking/hydroisomerisating the Fischer-Tropsch product;

(c) separating the product of step (b) into one or more gas oil fractions, a base oil precursor fraction and a higher boiling fraction;

(d) performing a pour point reducing step to the base oil precursor fraction obtained in step (c) thus producing an effluent; and (e) recovering the lubricating base oil from the effluent of step (d).

7. A lubricant formulation comprising a base oil composition formed from a Fischer-Tropsch derived product and having a viscosity index of above 120 and a pour point of below −15° C. and wherein the composition comprises at least 99.5 wt % saturates, of which saturates fraction between 10 and 40 wt % are cyclo-paraffins, the remainder being n- and iso-paraffins and wherein the weight ratio of 1-ring cyclo-paraffins relative to cyclo-paraffins having two or more rings is greater than 3; and, at least one lubricant additive.

8. The formulation of claim 7, wherein the formulation comprises at most 10 wt % of an additional base oil.

9. The formulation of claim 7, wherein the formulation has a kinematic viscosity at 100° C. of more than 5.6 cSt, a cold cranking simulated dynamic viscosity at −35° C. according to ASTM D 5293 of less than 6200 centiPoise (cP) and a mini rotary viscosity test value of less than 60000 cP according to ASTM D 4684.

10. The formulation of claim 9, wherein the base oil has a pour point of less than −39° C. and a kinematic viscosity at 100° C. of between 3.8 and 5.5 cSt and the lubricant composition has a kinematic viscosity at 100° C. of between 9.3 cSt and 12.5 cSt.

11. The base oil of claim 1 in which the oil comprises less than 1 wt % aromatic hydrocarbon compounds.

12. The process of claim 6 in which the catalyst of step (a) comprises a cobalt-containing catalyst obtained by the process comprising (i) mixing (1) titania or a titania precursor;

(2) a liquid; and, (3) a cobalt compound, which is at least partially insoluble in the amount of liquid used, to form a mixture;

(ii) shaping and drying of the mixture thus obtained; and, (iii) calcinating the mixture obtained from step (ii).

13. The process of claim 12 in which the catalyst of step (a) further comprises a promoter metal.

14. The process of claim 6 in which step (b) is performed in the presence of hydrogen and a catalyst.

15. The process of claim 6 in which the base oil precursor fraction has a $T_{10\ wt\ \%}$ boiling point in the range of from 200° C. and 450° C. and a $T_{90\ wt\ \%}$ boiling point in the range of from 300° C. and 650° C.

16. The process of claim 6 in which the pour point reducing step comprises catalytic dewaxing.

17. A passenger car motor oil comprising a base oil composition formed from a Fischer-Tropsch derived product and having a viscosity index of above 120 and a pour point of below −15° C. and wherein the composition comprises at least 99.5 wt % saturates, of which saturates fraction between 10 and 40 wt % are cyclo-paraffins, the remainder being n- and iso-paraffins and wherein the weight ratio of 1-ring cyclo-paraffins relative to cyclo-paraffins having two or more rings is greater than 3; and, at least one lubricant additive; and, wherein said motor oil has a grade of OW-X, wherein X is 20, 30 or 40.

18. The motor oil of claim 17 further comprising one or more additives.

19. A heavy duty diesel engine oil comprising a base oil composition formed from a Fischer-Tropsch derived product and having a viscosity index of above 120 and a pour point of below −15° C. and wherein the composition comprises at least 99.5 wt % saturates, of which saturates fraction between 10 and 40 wt % are cyclo-paraffins, the remainder being n- and iso-paraffins and wherein the weight ratio of 1-ring cyclo-paraffins relative to cyclo-paraffins having two or more rings is greater than 3; and, at least one lubricant additive.

20. An industrial oil formulation comprising more than 90 wt % of a base oil composition formed from a Fischer-Tropsch derived product and having a viscosity index of above 120 and a pour point of below −15° C. and wherein the composition comprises at least 99.5 wt % saturates, of which saturates fraction between 10 and 40 wt % are cyclo-paraffins, the remainder being n- and iso-paraffins and wherein the weight ratio of 1-ring cyclo-paraffins relative to cyclo-paraffins having two or more rings is greater than 3; and, at least one lubricant additive; and, between 0.5 wt % and 3 wt % of one or more additives.

* * * * *